US008608132B1

(12) United States Patent
Allen

(10) Patent No.: US 8,608,132 B1
(45) Date of Patent: Dec. 17, 2013

(54) FENCE POST EXTRACTOR

(76) Inventor: Kyle Allen, Grass Lake, MI (US)

( * ) Notice: Subject to any disclaimer, the term of this patent is extended or adjusted under 35 U.S.C. 154(b) by 562 days.

(21) Appl. No.: 12/909,328

(22) Filed: Oct. 21, 2010

(51) Int. Cl.
*E21B 19/00* (2006.01)

(52) U.S. Cl.
USPC ..... 254/30; 254/130

(58) Field of Classification Search
USPC ..... 254/30, 133 R, 134, 131, 130
See application file for complete search history.

(56) References Cited

U.S. PATENT DOCUMENTS

| | | | | |
|---|---|---|---|---|
| 1,153,024 | A | 9/1915 | Brown | |
| 1,469,911 | A | 10/1923 | Aumiller | |
| 1,932,540 | A | 10/1933 | Whipple | |
| 2,060,214 | A | 11/1936 | Hitchens | |
| 2,196,366 | A | 4/1940 | Simmons | |
| 2,229,364 | A | 1/1941 | Blackman | |
| 2,374,406 | A | 4/1945 | Bezzerides | |
| 2,634,157 | A | 4/1953 | Haddock | |
| 2,826,392 | A | 3/1958 | Kohorst | |
| 2,874,934 | A | 2/1959 | Dannehl | |
| 4,226,402 | A * | 10/1980 | Muth | 254/30 |
| 4,256,286 | A * | 3/1981 | Hudgins | 254/30 |
| 5,161,781 | A | 11/1992 | Sohocki | |
| 5,261,642 | A * | 11/1993 | Stambaugh | 254/30 |
| 7,290,754 | B2 * | 11/2007 | Mensi et al. | 254/30 |
| 7,478,794 | B1 * | 1/2009 | Gohlke et al. | 254/134.3 FT |
| 2007/0090332 | A1 * | 4/2007 | Mensi et al. | 254/30 |

* cited by examiner

*Primary Examiner* — Lee D Wilson
(74) *Attorney, Agent, or Firm* — Young Basile Hanlon & MacFarlane P.C.

(57) ABSTRACT

A fence post extractor includes a sleeve for receiving a fence post and a clamping bar that is pivotable with respect to the sleeve at a pivot joint. The clamping bar pivots between a first position where the fence post is clamped between a second end of the clamping bar and the sleeve, and a second position where the fence post is released with respect to the second end of the clamping bar. A powered lifting apparatus has an engaging portion that is engaged with the clamping bar. The engaging portion is moved under power between a raised position and a lowered position to move the clamping bar between the first and second positions.

16 Claims, 4 Drawing Sheets

FENCE POST EXTRACTOR

FIELD OF THE INVENTION

The invention relates to the field of tools for removing previously-installed fence posts.

BACKGROUND

Fence post removal can be a laborious and time-consuming task. In most cases, a very large pulling force must be applied to the fence post in order to remove it from an installed condition in the ground. Removal of fence posts is further complicated by the fact that it is difficult to securely grasp certain fence posts, either manually or using tools.

In order to overcome the challenges presented by fence post removal, a large number of tools have been previously proposed. The great majority of these tools rely on manual application of force in order to remove a fence post. Such tools may be suitable for removal of a small number of posts but are not well-suited for larger jobs, as the workers tasked with removing the fence posts will quickly become fatigued. A limited number of previous designs have attempted to apply some manner of powered lifting means to removal of a fence post. Some of these designs rely on leverage induced by rotation of a sleeve in which a pole is inserted. Such devices have no active clamping mechanisms but rather require that torque be applied to the fence post in order to grip the post and remove it from the ground. This requires a lifting means that can produce a very high degree of lifting force. As a result, the post may become damaged during removal to an extent that prevents reuse of the post.

Other designs have attempted to grip posts by use of a pawl-type arrangement or other mechanical catch that engages an irregular surface on the post itself. These designs are particularly adapted to remove fence posts of the well-known "T" post design. Such fence posts have a T-shaped cross-section and projections on one surface to which fencing can be attached. The projections provide an engagement surface for the pawl-type engaging member. In these designs, release of the fence post with respect to the tool may require operation of a release mechanism that causes the pawl-type engagement structure to disengage from the fence post. The need for manual disengagement, as well as the complexity associated with such a design, serve as impediments to widespread adoption and use of such a design.

It would be desirable to have a fence post extractor that could be operated by a powered lifting means, is capable of engaging the fence post without the need for application of a high degree of torque or lifting force, and may be released from engagement with the fence post without operation of a separate release mechanism.

SUMMARY OF THE INVENTION

The invention provides a fence post extractor for removing a fence post from the ground. The fence post extractor includes a sleeve, a clamping bar having a first end and a second end, a pivot joint, and a powered lifting apparatus. The fence post is receivable within the sleeve, and a pivot joint that pivotally connects that the clamping bar to the sleeve. The clamping bar is pivotable between a first position and a second position. The clamping bar is adapted to clamp the fence post between the second end of the clamping bar and the sleeve in the first position and to release the fence post with respect to the second end of the clamping bar in the second position. A powered lifting apparatus has an engaging portion that is engaged with the clamping bar. The engaging portion is selectively movable under power between a raised position and a lowered position. Movement of the engaging portion of the powered lifting device from the lowered position toward the raised position moves the clamping bar from the second position toward the first position. Movement of the engaging portion of the powered lifting device from the raised position toward the lowered position allows the clamping bar to move toward the second position.

The sleeve may have a lower open end and an upper open end, wherein the fence post is receivable within the sleeve such that it extends outward from both the lower open end of the sleeve and the upper open end of the sleeve. Furthermore, the sleeve may extend along a sleeve axis that is defined between the lower open end and the upper open end of the sleeve. The pivot joint may be configured such that the clamping bar is pivotable with respect to the sleeve about a pivot axis that is external to the sleeve.

The sleeve may extend along a sleeve axis that is defined between the lower open end and the upper open end of the sleeve. The pivot joint may be configured such that the clamping bar is pivotable with respect to the sleeve about a pivot axis that extends substantially perpendicular to the sleeve axis.

The sleeve may have a rear wall that extends from the lower open end to the upper open end, wherein the clamping bar is adapted to clamp the fence post between the second end of the clamping bar and the rear wall of the sleeve in the first position.

The first end of the clamping bar may be disposed at a first distance from the rear wall of the sleeve in the first position and at a second distance from the rear wall of the sleeve in the second position, the second distance being greater than the first distance.

The second end of the clamping bar may move pivotally in a direction from the lower open end of the sleeve toward the upper open end of the sleeve as the clamping bar is moved from the second position to the first position.

The engaging portion of the powered lifting apparatus may be engaged with the clamping bar between the pivot joint and the second end of the clamping bar.

The engaging portion of the powered lifting device may move the clamping bar from the second position toward the first position by exerting a force against a lower surface of the clamping bar while the engaging portion of the powered lifting device moves from the lowered position toward the raised position, thereby causing the fence post to be moveable upward in unison with the sleeve.

The engaging portion of the powered lifting device may allow the clamping bar to move from the raised position toward the lowered position by decreasing the force exerted against the lower surface of the clamping bar, thereby causing the sleeve to be moveable downward with respect to the fence post.

The sleeve may extend along a sleeve axis that is defined between the lower open end and the upper open end of the sleeve. The sleeve may be a tubular member having a polygonal cross-section transverse to the sleeve axis that is defined in part by the rear wall of the sleeve, a front wall of the sleeve, and first and second side walls that space the front wall from the rear wall. The front wall may have an opening formed through it, wherein the clamping bar extends through the opening in the first position. The opening may be spaced from each of the first open end and the second open end by at least part of the front wall of the sleeve.

The pivot joint may include a first support plate connected to the first side wall, a second support plate connected to the second side wall, an aperture defined by the clamping bar, and an axle that is supported between the first and second support plates adjacent to the opening and extends through the aperture of the clamping bar.

The powered lifting apparatus may include a tractor and a draw bar assembly, the draw bar assembly including the engaging portion, and the tractor configured to move the draw bar assembly between the raised and lowered positions under power.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
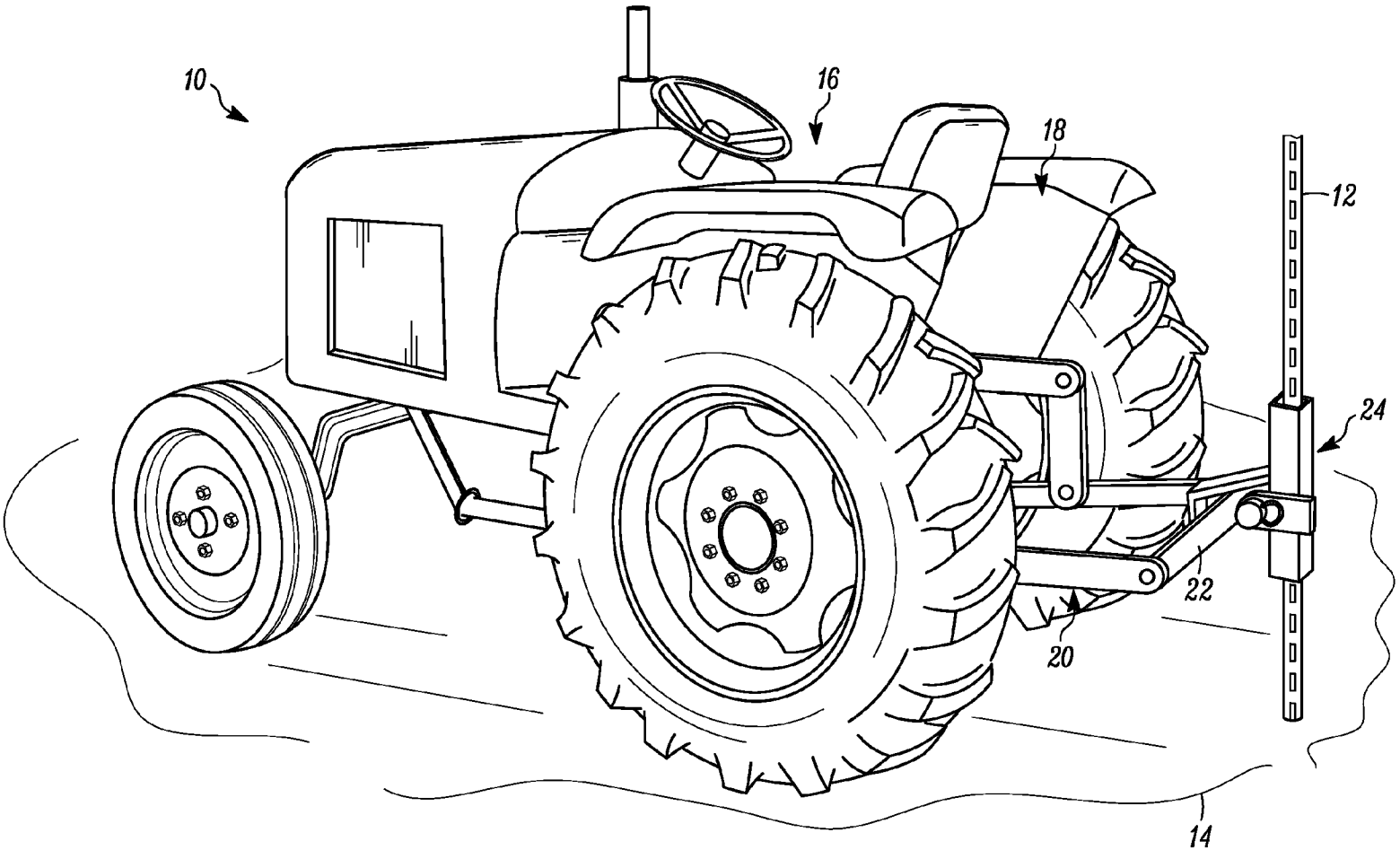
FIG. 1 is a perspective view showing a fence post extractor according to the present invention including a post clamp and a powered lifting apparatus.

FIG. 1 shows a fence post extractor 10 according to the present invention for removing previously-installed fence posts 12 from the ground 14. The fence post extractor 10 includes a powered lifting apparatus, which, in the illustrated embodiment, includes a tractor 16 having a powered actuator 18 that is operable to raise and lower a draw bar assembly 20. The draw bar assembly 20 includes an engaging portion 22 such as a cross bar 22 that engages a post clamp 24 that is configured to clamp and release with respect to the fence post 12 in response to raising and lowering of the engaging portion 22 of the draw bar assembly 20 under power from the powered actuator 18 of the tractor 16, as will be explained in detail herein.

As noted above, the powered lifting apparatus of the illustrated embodiment includes a tractor 16. It should be noted, however, that other machines and structures having a powered actuator 18 and being capable to raise and lower an engaging portion 22 could be utilized. The powered actuator 18 may be a rotary actuator, such as a rotational output of the drive train of the tractor 16. Alternatively, the powered actuator 18 could be a linear actuator, such as a hydraulic cylinder that is powered by a hydraulic system of the tractor 16. It should be understood that the powered actuator is not limited to the specific structures mentioned herein, but rather, could be any non-manual prime mover capable of raising and lowering the engaging portion 22 of a powered lifting apparatus with sufficient force to remove the fence post 12 from the ground 14 using the post clamp 24.

Figure 2:
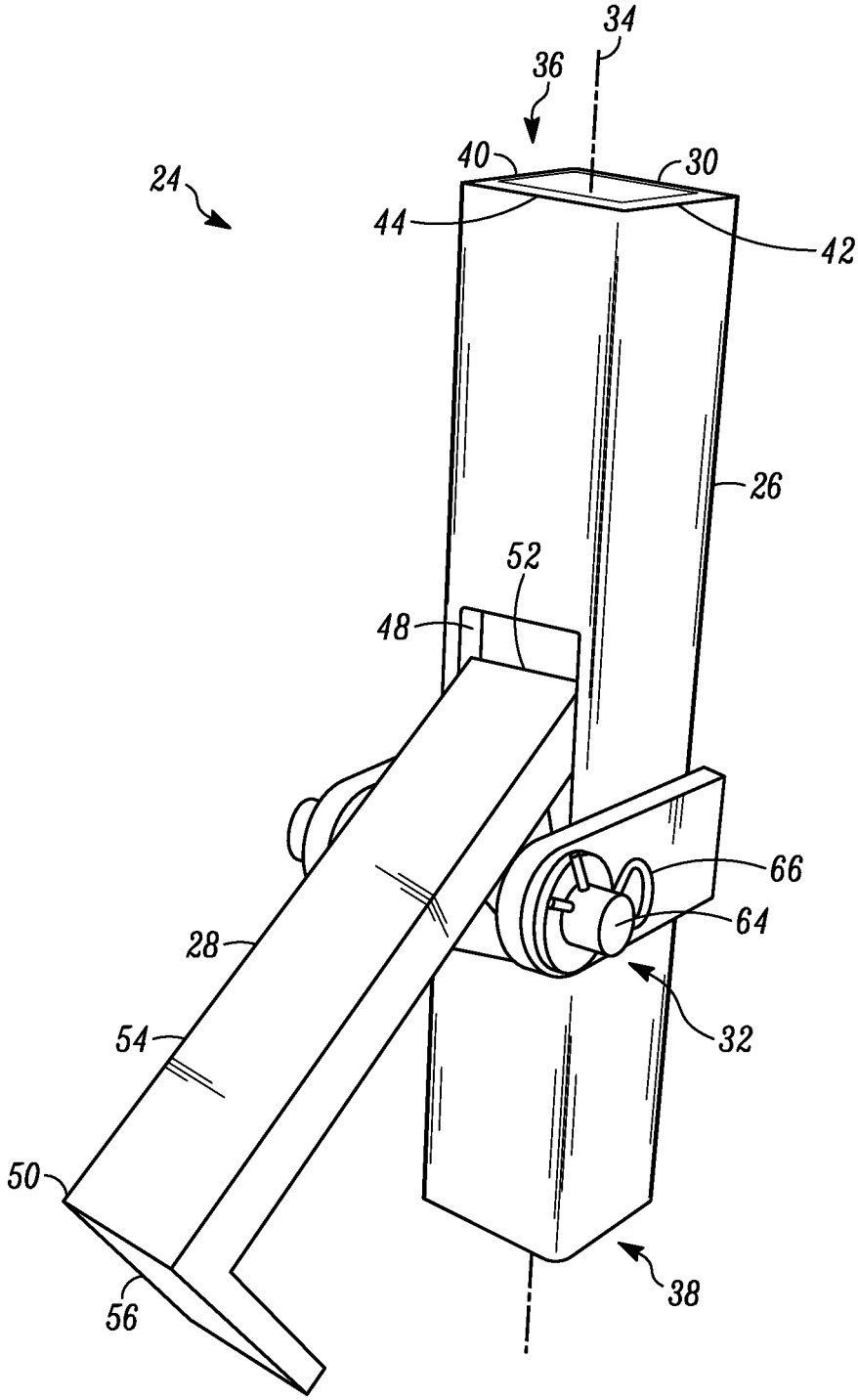
FIG. 2 is a perspective view showing the post clamp of FIG. 1.
Figure 3:
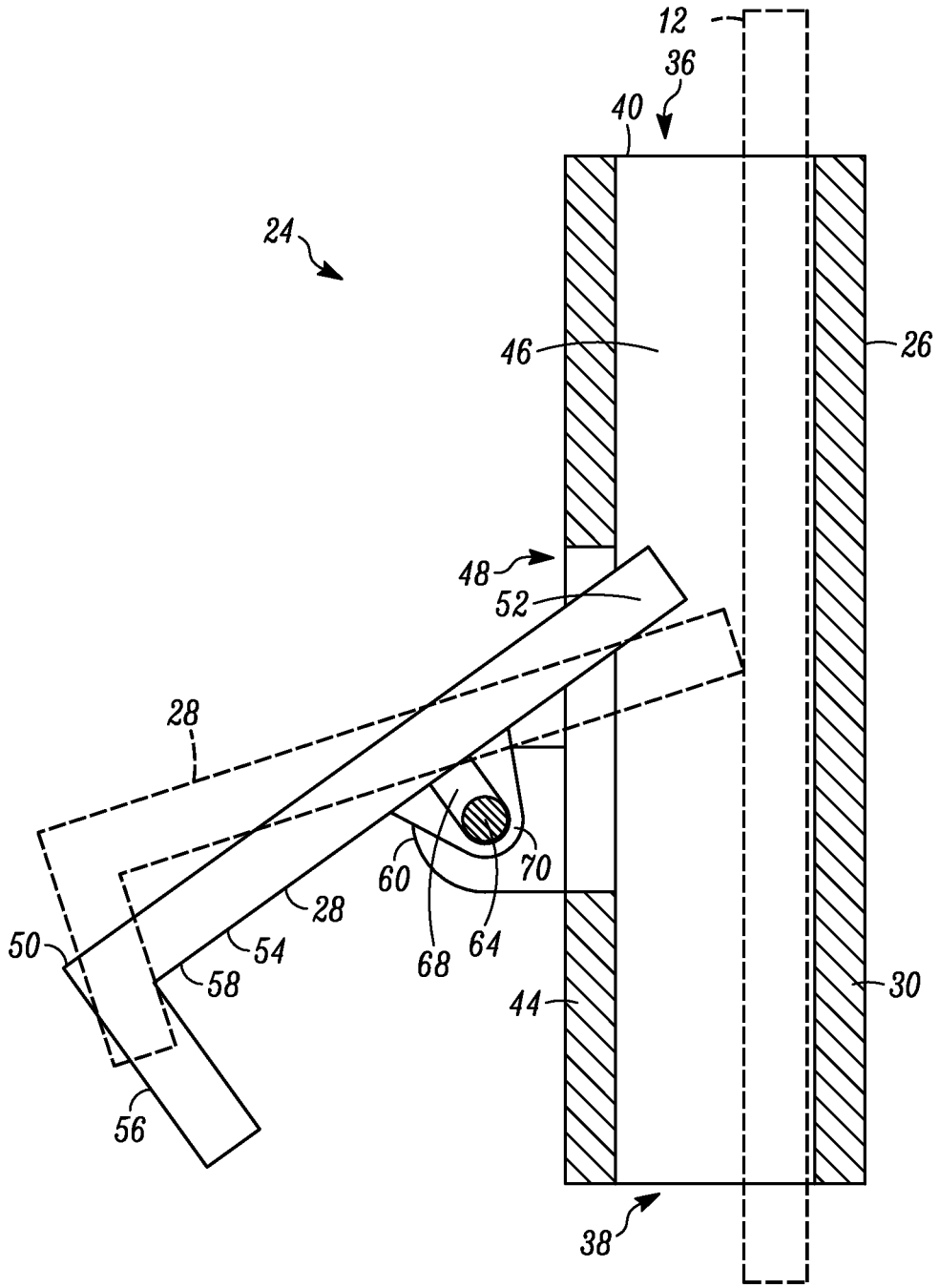
FIG. 3 is a side, cross-section view showing the post clamp of FIG. 1.

As shown in FIGS. 2-3, the post clamp 24 includes a sleeve 26, in which the fence post 12 is receivable, and a clamping bar 28. The clamping bar 28 is configured to selectively clamp and release the fence post 12 with respect to the sleeve 26 by pivotal movement of the clamping bar 28 with respect to the sleeve 26, as will be explained in detail herein.

The sleeve 26 may be any tubular or non-tubular structure that provides a surface against which the fence post 12 can be clamped by the clamping bar 28. Generally speaking, it is sufficient that the sleeve 26 include at least one wall, such as a rear wall 30, and structure by which the clamping bar 28 may be pivotally mounted with respect to the sleeve 26 for rotation about a pivot axis at a pivot joint 32.

In the illustrated embodiment, the sleeve 26 has a polygonal cross-section and more particularly, a square cross-section in a direction that is substantially perpendicular to a longitudinal axis 34 of the sleeve 26. The longitudinal axis 34 is defined between an upper open end 36 and a lower open end 38 of the sleeve 26. In addition to the rear wall 30, the cross-section of the sleeve 26 is further defined by a first side wall 40, a second side wall 42, and a front wall 44.

So that the clamping bar 28 may extend at least partially into an interior 46 of a window-like opening 48 is formed through the front wall 44 of the sleeve 28 at an intermediate location between the upper open end 36 and the lower open end 38 of the sleeve 28. The opening 48 may be spaced from each of the upper open end 36 and the lower open end 38 of the sleeve 26 by at least a portion of the front wall 44, such that the opening 48 is not contiguous with either of the upper open end 36 or the lower open end 38. In contrast to the front wall 44, each of the rear wall 30, the first side wall 40, and the second side wall 42 may be extend substantially continuously and without interruption between the upper open end 36 and the lower open end 38 of the sleeve 26.

The clamping bar 28 of the post clamp 24 extends from a first end 50, adjacent to which the clamping bar 28 is engageable with the engaging portion 22 of the draw bar assembly 20, and a second end 52 that is disposable within the interior 46 of the sleeve 26 for selective engagement with the fence post 12 to allow clamping and releasing of the fence post 12 with respect to the rear wall 30 of the sleeve 26.

The clamping bar 28 includes a primary portion 54 that extends from the first end 50 to the second end 52 thereof, as well as a retaining flange 56 that is positioned at the second end 52 of the clamping bar 28 and extends downward with respect to a lower surface 58 of the clamping bar 28. The retaining flange 56 may be a substantially planar member that extends substantially perpendicular to the primary portion 54 of the clamping bar 28, thus forming a L-shaped configuration for the clamping bar 28.

During operation of the fence post extractor 10, the engaging portion 22 of the draw bar assembly engages the lower surface 58 of the clamping bar 28 to exert a force in an upward direction on the clamping bar 28 to pivot the clamping bar 28 such that the fence post 12 is clamped between the second end 52 of the clamping bar 28 and the rear wall 30 of the sleeve 26. At the same time, engagement of the retaining flange 56 of the clamping bar 28 with the engaging portion 22 of the draw bar assembly 20 prevents disengagement of the engaging portion 22 of the draw bar assembly 20 with respect to the clamping bar 28.

In order to allow pivotal movement of the clamping bar 28 with respect to the sleeve 26 of the post clamp 24, the pivot joint 32 is provided. The pivot joint 32 includes a first support plate 60 that is connected to the first side wall 40 of the sleeve 26, as well as a second support plate 62 that is connected to the second side wall 42 of the sleeve 26. The first and second support plates 60, 62 may be positioned along or slightly below the opening 48 in the front wall 44 of the sleeve 26. Thus, the first and second support plates 60, 62 are spaced apart from one another by the front wall 44 of the sleeve 26 and are positioned adjacent to the opening 48.

The pivot joint 32 also includes an axle 64 that extends along the pivot axis, substantially perpendicular to the longitudinal axis 34 of the sleeve 26. The axle 64 is supported by and extends between the first support plate 60 and the second support plate 62. The axle 64 is retained with respect to the first and second support plates by appropriate hardware 66, such as washers and pins. The axle 64 extends through an aperture 68 that is defined by the clamping bar 28. The aperture 68 extends substantially transverse to the primary portion 54 of the clamping bar 28 with respect to the direction defined between the first and second ends 50, 52 of the clamping bar 28. The aperture 68 may be defined by a yoke portion 70 that is formed on the primary portion 54 of the clamping bar 28 and extends downward from the lower surface 58 thereof.

The pivot joint 32 allows the clamping bar 28 to be pivotable between a first position and a second position with respect to the sleeve 26. The first position and the second position differ with regard to the distance by which the second end 52 of the clamping bar 28 is spaced from the rear wall 30 of the sleeve 26. This is seen in FIG. 3, where the second position of the clamping bar 28 is illustrated in solid lines and the first position of the clamping bar 28 is illustrated in dashed lines. In the first position, the second end 52 of the clamping bar 28 is spaced from the rear wall 30 of the sleeve 26 by a first distance. In the second position, the second end 52 of the clamping bar 28 is spaced from the rear wall 30 of the sleeve 26 by a second distance, where the second distance is greater than the first distance.

In the first position, the clamping bar 28 is adapted to clamp the fence post 12 between the second end 52 of the clamping bar 28 and the sleeve 26. As shown in the illustrated embodiment, the fence post 12 is clamped between the second end 52 of the clamping bar 28 and the rear wall 30 of the sleeve 26. In the second position, the clamping bar moves away from the rear wall 30 of the sleeve 26 such that the clamping bar 28 is adapted to release the fence post 12 from its clamped engagement with respect to the second end 52 of the clamping bar 28 and the rear wall 30 of the sleeve 26. In this regard, it is noted that the second end 52 of the clamping bar 28 is shown herein as being substantially straight. Such a configuration is suitable for engaging and clamping a wide variety of fence posts 12. However, it is specifically contemplated that the second end 52 of the clamping bar 28 could be provided with any configuration that is suitable for engaging a particular fence post 12. For example, the second end 52 of the clamping bar 28 could be curved to allow engagement with round fence posts 12.

From the foregoing, it will be appreciated that the first end of the clamping bar 28 moves pivotally upward in a direction defined from the lower open end 38 toward the upper open end 36 of the sleeve 26 as the clamping bar 28 is moved from the second position toward the first position. Conversely, the first end 50 of the clamping bar 28 moves pivotally downward in a direction defined from the upper open end 36 toward the lower open end 38 of the sleeve 26 as the clamping bar 29 is moved from the first position toward the second position. As a result, the clamping bar 28 will move pivotally from the second position toward the first position when an upward lifting force is applied to the lower surface 58 of the clamping bar 28 by the engaging portion 22 of the draw bar assembly 20, and the clamping bar 28 will move pivotally from the first position toward the second position as the force applied by the engaging portion 22 of the draw bar assembly 20 is diminished or removed.

Figure 4:
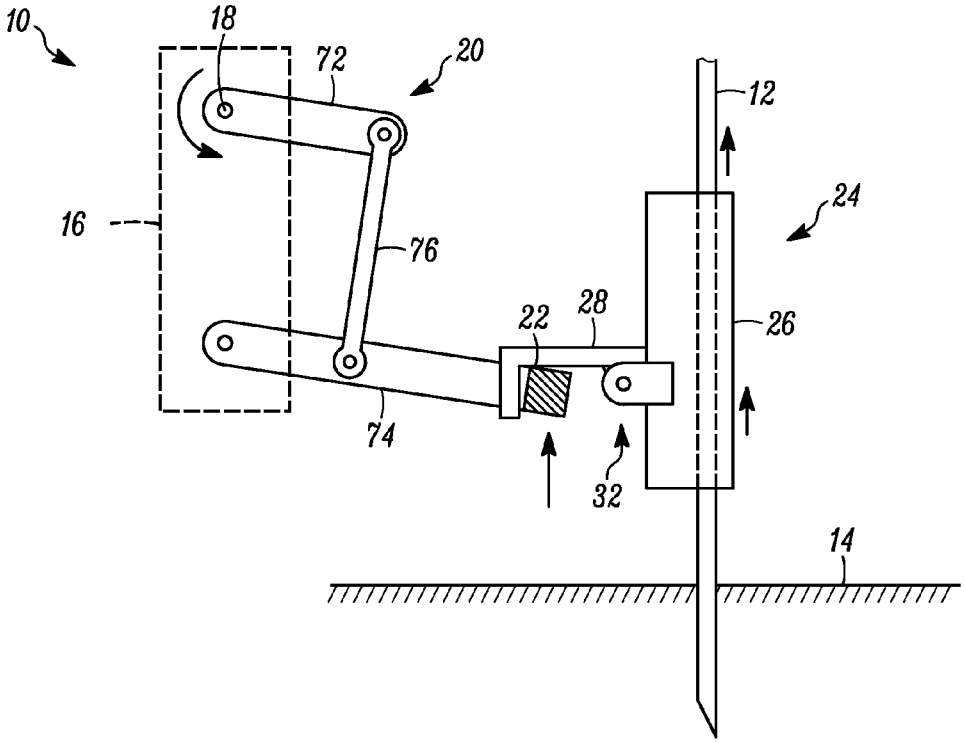
FIG. 4 is an illustration showing the fence post extractor of FIG. 1, wherein the post clamp and fence post are being raised in unison by the powered lifting apparatus.

FIG. 4 shows the fence post extractor 10 during upward movement of the engaging portion 22 of the draw bar assembly 20. As shown in FIG. 4, the draw bar assembly 20 includes an upper bar 72, a lower bar 74 to which the engaging portion 22 is connected, and a supporting bar 76 that interconnects the upper bar 72 with the lower bar 74 such that they move in unison. The upper and lower bars 72, 74 are both pivotally supported with respect to the tractor 16. A rotational input is provided by the powered actuator 18 to the upper bar 72 in order to raise the engaging portion 22 under power. As the engaging portion 22 is raised, the clamping bar 28 of the post clamp 24 is moved toward the second position, thus clamping the post clamp 24 with respect to the fence post 12. At this time, further upward movement of the engaging portion 22 of the draw bar assembly 20 under power from the powered actuator 18 will cause the draw bar assembly 20, the post clamp 24, and the fence post 12 to move upward in unison, thereby pulling the fence post 12 upward out of the ground 14. Because the fence post 12 may be very long and have a significant length thereof embedded within the ground 14, a single upward movement of the engaging portion 22 of the draw bar assembly 20 might be insufficient to remove the fence post 12 from the ground 14. Thus, the post clamp 24 will need to be lowered with respect to the fence post 12 so that the fence post 12 may be moved upward again.

Figure 5:
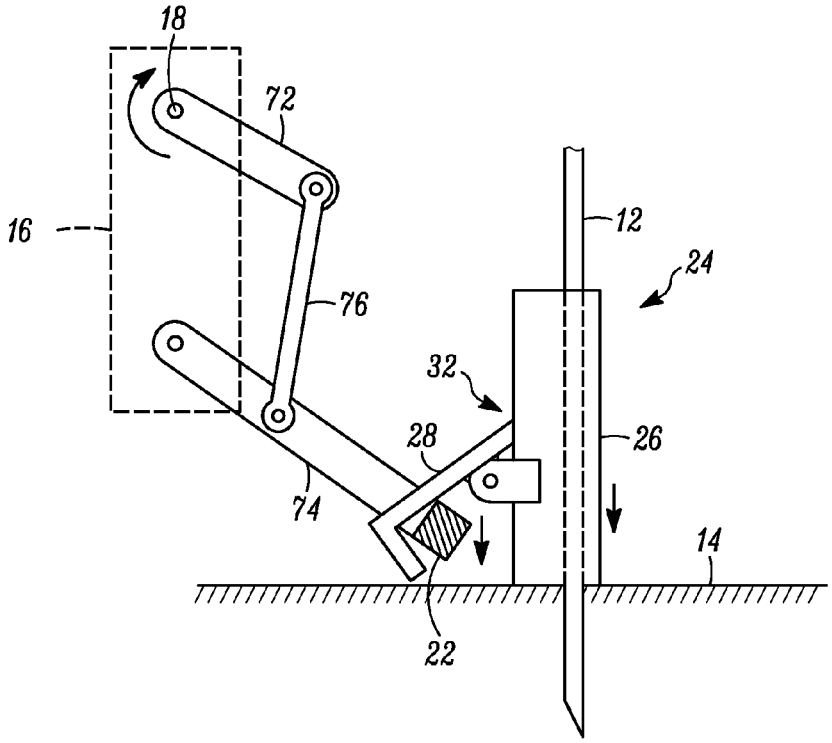
FIG. 5 shows the fence post extractor of FIG. 1, wherein the post clamp is being lowered with respect to the fence post by downward movement of the powered lifting apparatus.

As shown in FIG. 5, downward movement of the engaging portion 22 of the draw bar assembly 20 occurs in response to an opposite rotational input by the powered actuator 18 of the tractor 16. As the force applied to the clamping bar 28 by the engaging portion 22 of the draw bar assembly 20 is reduced or removed by downward motion of the engaging portion 22, the clamping bar 28 moves toward the first position, thus releasing the post 12 from its clamped condition with respect to the post clamp 24. Because the post clamp 24 is no longer being supported at its former elevation with respect to the fence post 12, and also because the clamp between the post clamp 24 and the fence post 12 has been released, the post clamp 24 moves downward in unison with the engaging portion 22 of the draw bar assembly 20. In this manner, the post clamp 24 may be lowered all or part of the way to the ground 14. Once this is done, the post clamp 24 may be raised under power from the powered actuator 18 and draw bar assembly 20. Incremental upward motion of the post clamp 24 in unison with the fence post 12 may be repeated until the fence post 12 is removed from the ground 14.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A fence post extractor for removing a fence post from the ground, comprising:

a sleeve that extends along a sleeve axis, the sleeve having a lower open end, an upper open end, a rear wall, a front wall, a first side wall, a second side wall, and an opening formed through the first side wall, the opening being spaced from each of the lower open end and the upper open end by at least part of the front wall of the sleeve, wherein the fence post is receivable within the sleeve;

a clamping bar having a first end and a second end;

a pivot joint that pivotally connects that the clamping bar to the sleeve the pivot joint including a first support plate connected to the first side wall, a second support plate connected to the second side wall, an aperture defined by the clamping bar, and an axle that is supported between the first and second support plates adjacent to the opening and extends through the aperture of the clamping bar;

the clamping bar being pivotable between a first position and a second position, the clamping bar adapted to clamp the fence post between the second end of the clamping bar and the rear wall of the sleeve in the first position and to release the fence post with respect to the second end of the clamping bar in the second position, wherein the clamping bar extends through the opening through the front wall of the sleeve when the clamping bar is in the first position; and a powered lifting apparatus having an engaging portion that is engaged with the clamping bar, the engaging portion being selectively movable under power between a raised position and a lowered position, wherein movement of the engaging portion of the powered lifting device from the lowered position toward the raised position moves the clamping bar from the second position toward the first position, and movement of the engaging portion of the powered lifting device from the raised position toward the lowered position allows the clamping bar to move toward the second position.

2. The fence post extractor of claim 1, further comprising:

the pivot joint being configured such that the clamping bar is pivotable with respect to the sleeve about a pivot axis that is external to the sleeve.

3. The fence post extractor of claim 1, further comprising:

the pivot joint being configured such that the clamping bar is pivotable with respect to the sleeve about a pivot axis that extends substantially perpendicular to the sleeve axis.

4. The fence post extractor of claim 1, further comprising:

the second end of the clamping bar being disposed at a first distance from the rear wall of the sleeve in the first position and at a second distance from the rear wall of the sleeve in the second position, the second distance being greater than the first distance.

5. The fence post extractor of claim 1, further comprising:

the first end of the clamping bar moving pivotally in a direction from the lower open end of the sleeve toward the upper open end of the sleeve as the clamping bar is moved from the second position to the first position.

6. The fence post extractor of claim 1, further comprising:

the engaging portion of the powered lifting apparatus being engaged with the clamping bar between the pivot joint and the first end of the clamping bar.

7. The fence post extractor of claim 1, wherein the engaging portion of the powered lifting device moves the clamping bar from the second position toward the first position by exerting a force against a lower surface of the clamping bar while the engaging portion of the powered lifting device moves from the lowered position toward the raised position, thereby causing the fence post to be moveable upward in unison with the sleeve.

8. The fence post extractor of claim 7, wherein the engaging portion of the powered lifting device allows the clamping bar to move from the raised position toward the lowered position by decreasing the force exerted against the lower surface of the clamping bar, thereby causing the sleeve to be moveable downward with respect to the fence post.

9. The fence post extractor of claim 1, wherein the powered lifting apparatus includes a tractor and a draw bar assembly, the draw bar assembly including the engaging portion, and the tractor configured to move the draw bar assembly between the raised and lowered positions under power.

10. A fence post extractor for removing a fence post from the ground, comprising:

a sleeve having an upper end, a lower end, and an opening formed through a wall of the sleeve, wherein the opening is spaced from the upper end and the lower end, and the fence post is receivable within the sleeve;

a clamping bar having a first end and a second end, wherein the clamping bar extends through the opening of the sleeve;

a pivot joint that pivotally connects that the clamping bar to the sleeve, the pivot joint having an axle that is positioned adjacent to the opening for pivotally supporting the clamping bar;

the clamping bar being pivotable between a first position and a second position, the clamping bar adapted to clamp the fence post between the second end of the clamping bar and the sleeve in the first position and to release the fence post with respect to the second end of the clamping bar in the second position; and a powered lifting apparatus having an engaging portion that is engaged with the clamping bar, the engaging portion being selectively movable under power between a raised position and a lowered position, wherein movement of the engaging portion of the powered lifting device from the lowered position toward the raised position moves the clamping bar from the second position toward the first position, and movement of the engaging portion of the powered lifting device from the raised position toward the lowered position allows the clamping bar to move toward the second position.

11. The fence post extractor of claim 10, wherein the axle is positioned adjacent to an exterior of the sleeve.

12. The fence post extractor of claim 10, wherein the pivot joint includes a first support plate that is connected to an exterior of the sleeve adjacent to the opening, and a second support plate that is connected to the exterior of the sleeve adjacent to the opening, wherein the axle extends between the first support plate and the second support plate.

13. The fence post extractor of claim 10, wherein the powered lifting apparatus includes a tractor and a draw bar assembly, the draw bar assembly including the engaging portion, and the tractor configured to move the draw bar assembly between the raised and lowered positions under power.

14. A fence post extractor for removing a fence post from the ground, comprising:

a sleeve having an upper end, a lower end, and an opening formed through a wall of the sleeve, wherein the opening is spaced from the upper end and the lower end, and the fence post is receivable within the sleeve;

a clamping bar having a first end and a second end, wherein the clamping bar extends through the opening of the sleeve;

a pivot joint that pivotally connects that the clamping bar to the sleeve, the pivot joint having an axle that is positioned adjacent to the opening for pivotally supporting the clamping bar; and the clamping bar being pivotable between a first position and a second position, the clamping bar adapted to clamp the fence post between the second end of the clamping bar and the sleeve in the first position and to release the fence post with respect to the second end of the clamping bar in the second position, wherein application of an upward force to the clamping bar at the first end of the sleeve is operable to move the sleeve from the second position toward the first position, for clamping the fence post and applying the upward force thereto.

15. The fence post extractor of claim 14, wherein the axle is positioned adjacent to an exterior of the sleeve.

16. The fence post extractor of claim 14, wherein the pivot joint includes a first support plate that is connected to an exterior of the sleeve adjacent to the opening, and a second support plate that is connected to the exterior of the sleeve adjacent to the opening, wherein the axle extends between the first support plate and the second support plate.

* * * * *